US011298280B2

(12) United States Patent
MayField

(10) Patent No.: US 11,298,280 B2
(45) Date of Patent: Apr. 12, 2022

(54) WHEELCHAIR INCORPORATED WITH A LIFT APPARATUS

(71) Applicant: Ken MayField, Tyler, TX (US)

(72) Inventor: Ken MayField, Tyler, TX (US)

( * ) Notice: Subject to any disclaimer, the term of this patent is extended or adjusted under 35 U.S.C. 154(b) by 320 days.

(21) Appl. No.: 16/363,667

(22) Filed: Mar. 25, 2019

(65) Prior Publication Data

US 2020/0306113 A1 Oct. 1, 2020

(51) Int. Cl.
*A61G 5/10* (2006.01)
*A61G 5/08* (2006.01)

(52) U.S. Cl.
CPC ..... *A61G 5/104* (2013.01); *A61G 5/0891* (2016.11); *A61G 5/1048* (2016.11)

(58) Field of Classification Search
CPC .... A61G 5/104; A61G 5/0891; A61G 5/1048; A61G 7/057
USPC ..... 280/250.1
See application file for complete search history.

(56) References Cited

U.S. PATENT DOCUMENTS 3,882,949 A * 5/1975 Anderson ..... A61G 5/06 180/8.2
6,588,792 B1 * 7/2003 Koerlin ..... A61G 5/006 280/304.1
2010/0148466 A1 * 6/2010 Richter ..... A61G 5/1059 280/250.1
2012/0295778 A1 * 11/2012 Johansson ..... A63B 23/03525 482/131
2015/0190292 A1 * 7/2015 Robins ..... A61G 5/02 180/366

* cited by examiner

*Primary Examiner* — Minnah L Seoh
*Assistant Examiner* — Felicia L. Brittman
(74) *Attorney, Agent, or Firm* — Wilson Daniel Swayze, Jr.

(57) ABSTRACT

A wheelchair incorporated with a lift apparatus is disclosed. The wheelchair comprises a pair of seat frame support bars, backrest support bars, and armrest frame support bars for supporting at least one seat cushion, backrest cushion, and armrest cushions. The wheelchair further comprises lower support bars positioned parallel and opposite each other on both sides of the wheelchair. The support assembly includes a plurality of scissor links pivotally connected to each other, and an end of the plurality of scissor links is pivotally affixed with needle bearings to the lower support bars and the seat frame support bars. The lift apparatus includes one or more actuators, positioned between the lower support bars and at least one scissor link on both sides. The actuators are configured to raise and lower the seat cushion by raising at least one scissor link, thereby raising and lowering the seat cushion to a desired adjustable height for the user.

19 Claims, 9 Drawing Sheets

WHEELCHAIR INCORPORATED WITH A LIFT APPARATUS

BACKGROUND OF THE INVENTION

A. Technical Field

The present invention generally relates to a wheelchair with a lift apparatus. More specifically, the present invention relates to a wheelchair incorporated with a lift apparatus to aid and improve mobility for disabled individuals and wheelchair users.

B. Description of Related Art

A person with disabilities may face many challenges and difficulties in performing their normal daily activities, and one of the most challenging is mobility for transportation and other purposes. Being a wheelchair user is difficult to enough without the added stress of a caregiver being on continuous duty when the need arises to travel in an automobile or at different places, for example, in hospital. Further, the wheelchair user could not be able to reach an item(s) or product(s) located at a height on the desks/cabinets in home, grocery stores, super market, closets, and retail stores. However, the caregiver is unable to aid the wheelchair user in many cases so it requires waiting for someone. In critical situations, waiting is not always an option such as a medical emergency and the situation could become life-threating quickly.

Currently, existing wheelchairs are provided with limited features with minimal mobility. The existing wheelchairs could not provide flexibility and comfort for the wheelchair users. The existing wheelchairs are not suitable for individuals whose primary means of mobility will be a wheelchair. These existing wheelchairs also provide limited support for seating balance and fixed seating does not provide flexibility for reclining positions for the user to increase comfort by shifting body positions.

Therefore, there is a need for a wheelchair with lift apparatus suitable for raising/lifting and lowering the wheelchair user/handicapped persons up to a height of stages and platforms in a safe and reliable manner There is a need for a wheelchair with lift apparatus for providing flexibility and comfort for the handicapped person/user. There is a need for a wheelchair with lift apparatus for assisting handicapped person/user to achieve maximum mobility and independence. Further, there is also a need to provide a wheelchair with adjustable seat assembly for flexibly reclining positions for the handicapped person/user to increase comfort by shifting body positions.

SUMMARY OF THE INVENTION

The present invention discloses a wheelchair incorporated with a lift apparatus. In one embodiment, the wheelchair is configured to aid and improve mobility for disabled individuals or wheelchair users. The wheelchair could provide flexibility and comfort for the wheelchair users. In one embodiment, the wheelchair comprises a pair of seat frame support bars, a pair of backrest support bars, and a pair of armrest frame support bars. The seat frame support bars are configured to secure at least one seat cushion. In one embodiment, the backrest support bars are configured to secure a backrest cushion. The backrest cushion is configured to adjust at desired angle positions for providing flexibility and comfort for the user. In one embodiment, the wheelchair further comprises a pair of armrest cushions affixed to the pair of armrest frame support bars.

In one embodiment, the armrest frame support bars are movably affixed to the pair of backrest support bars. The armrest frame support bars are configured to securely hold armrest cushions. In one embodiment, the wheelchair further comprises a pair of lower support bars and a support assembly. The lower support bars are positioned parallel and opposite each other on both sides of the wheelchair. The support assembly includes a plurality of scissor links on both sides of the wheelchair. In one embodiment, the plurality of scissor links on both sides is pivotally connected to each other, and an end of the plurality of scissor links is pivotally affixed with needle bearings to the lower support bars and the seat frame support bars via fasteners. In one embodiment, the components of the wheelchair such as, but not limited to, lower frame support bars, seat frame support bars, backrest support bars, seat cushion, and backrest cushion are made of a material, but not limited to, a metal. In a preferred embodiment, the components of the wheelchair are made of high strength aircraft grade aluminum.

In one embodiment, the wheelchair is incorporated with a lift apparatus. In one embodiment, the lift apparatus includes one or more actuators. In one embodiment, the actuators could be positioned between, but not limited to, the lower support bars and at least one scissor link on both sides of the wheelchair. In one embodiment, the actuators are configured to raise and lower the seat cushion by raising at least one scissor link, thereby raising and lowering the seat cushion to a desired adjustable height for the user. In one embodiment, the actuators could be, but not limited to, micro-electrical actuators. In one embodiment, at least one actuator could be diametrically disposed between the support assembly. The actuator is configured to stabilize the wheelchair for lateral movements. In one embodiment, the wheelchair further comprises an automatic powered mechanical assist, configured to automatically fold and unfold the wheelchair.

In one embodiment, the wheelchair further comprises a foot rest assembly. The foot rest assembly includes a pair of leg support bars carrying foot rests, pivotally affixed to the seat frame support bars via gas shock absorbers. The gas shock absorbers are disposed between the leg support bars and the at least one scissor link on both sides. The gas shock absorbers are configured to provided flexible movement for the foot rest assembly. The foot rests are configured to adjust at desired angle positions for providing flexibility and comfort for the user. The foot rests further comprise extension platforms, configured to extend and retract to a desired length for accommodating different foot sizes of the users. In one embodiment, the wheelchair further comprises a pair of front wheels and rear wheels. The front wheels rotate 360 degrees and rear wheels an both affixed to the pair of lower support bars, configured to rotate in a direction for providing maximum mobility for the wheelchair.

In one embodiment, the wheelchair further comprises a rear wheel braking system, configured to lock the rear wheels before initiating the lift apparatus for lifting the seat cushion to a desired height. The rear wheel braking system is further configured to easily brake the rear wheels and control the speed of the wheelchair. In one embodiment, the rear wheel braking system includes a brake lever, a brake plate, and a brake pad, positioned at a center portion of the rear wheels. In one embodiment, the brake lever is disposed at the center portion of the rear wheels to enable the user for easily braking the rear wheels while in motion to control the speed of the wheelchair. In one embodiment, the wheelchair further comprises shock absorbers positioned between the plurality of scissor links, configured to provide stability and reduce friction between the plurality of scissor links. In one embodiment, the shock absorbers could be, but not limited to, rubber shock absorbers.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

BRIEF DESCRIPTION OF DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and structures disclosed herein. The description of a method step or a structure referenced by a numeral in a drawing is applicable to the description of that method step or structure shown by that same numeral in any subsequent drawing herein.

DETAILED DESCRIPTION OF EMBODIMENTS

A description of embodiments of the present invention will now be given with reference to the Figures. It is expected that the present invention may be embodied in other specific forms without departing from its spirit or essential characteristics. The described embodiments are to be considered in all respects only as illustrative and not restrictive.

Figure 1:
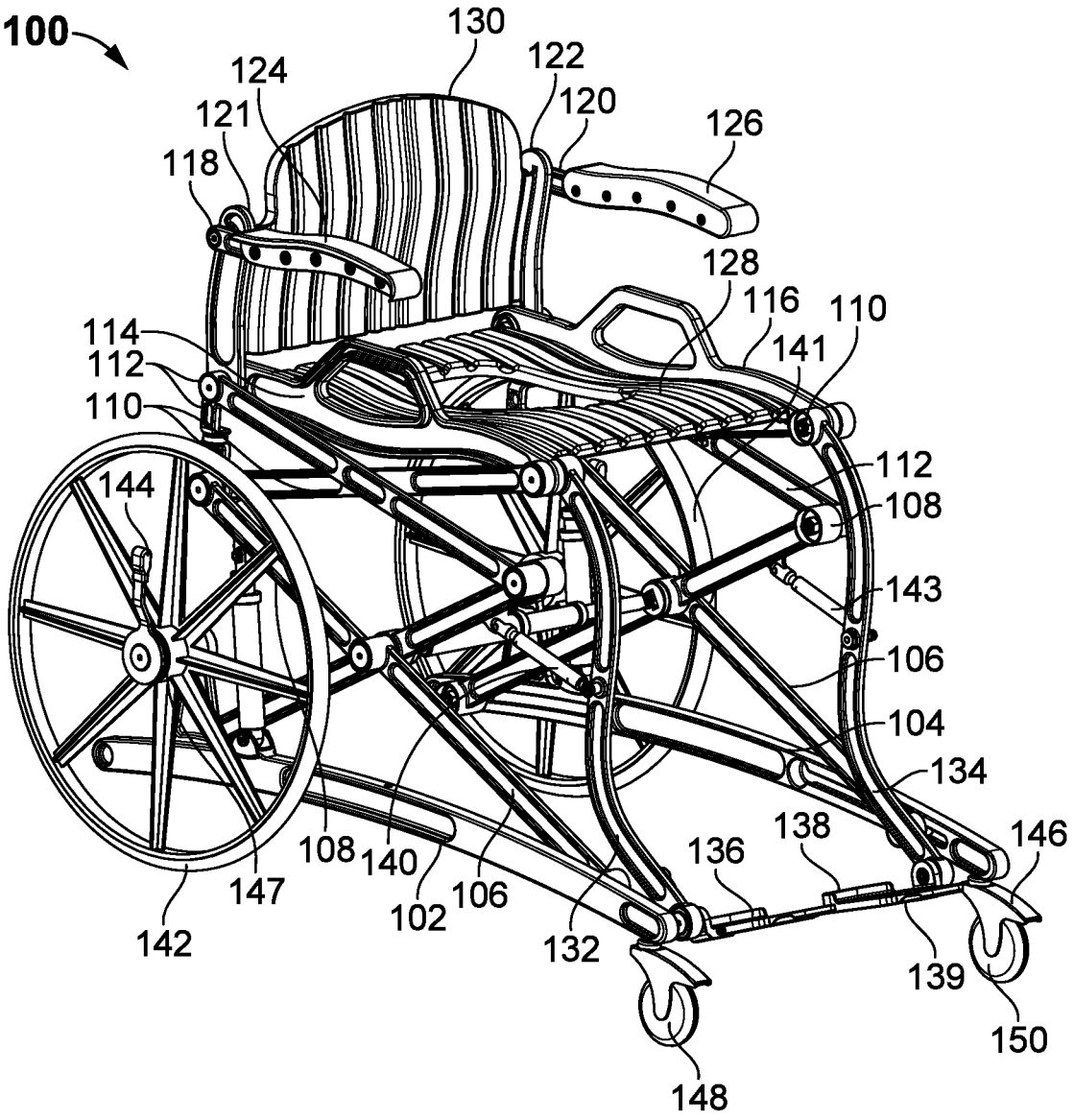
FIG. 1 shows a perspective view of a wheelchair incorporated with a lift apparatus in an embodiment of the present invention.

Referring to FIG. 1, a wheelchair 100 incorporated with a lift apparatus is disclosed. In one embodiment, the wheelchair 100 is configured to aid and improve mobility for disabled individuals or wheelchair users. The wheelchair 100 could provide flexibility and comfort for the wheelchair users. In one embodiment, the wheelchair 100 comprises a pair of seat frame support bars (114 and 116), a pair of backrest support bars (121 and 122), and a pair of armrest frame support bars (118 and 120). The seat frame support bars (114 and 116) are configured to secure at least one seat cushion 128. In one embodiment, the backrest support bars (121 and 122) are configured to secure a backrest cushion 130. In one embodiment, the armrest frame support bars (118 and 120) are movably affixed to the pair of backrest support bars (121 and 122). The armrest frame support bars (118 and 120) are configured to securely hold armrest cushions (124 and 126). The armrest frame support bars (118 and 120) are configured to rotate 90 degrees from the stowed or deployed positions. The armrest frame support bars (118 and 120) could operate independently of each other, which allows a variety of functions; rotating up or down for arm support, table clearance or desk height, and enable the user to easily shift onto beds, automobiles, and shifts onto medical diagnostic equipment etc.

In one embodiment, the wheelchair 100 further comprises a pair of lower support bars (102 and 104) and a support assembly. The lower support bars (102 and 104) are positioned parallel an opposite each other on both sides of the wheelchair 100. The support assembly includes a plurality of scissor links (106, 108, 110, and 112) on both sides of the wheelchair 100. In one embodiment, the plurality of scissor links (106, 108, 110, and 112) on both sides is pivotally connected to each other, and an end of the plurality of scissor links (106, 108, 110, and 112) is pivotally affixed with needle bearings to the lower support bars (102 and 104) and the seat frame support bars (114 and 116) via fasteners.

In one embodiment, the wheelchair 100 is incorporated with a lift apparatus. In one embodiment, the lift apparatus includes one or more actuators (154 and 156) (shown in FIG. 4). In one embodiment, the actuators (154 and 156) could be positioned between, but not limited to, the lower support bars (102 and 104) and at least one scissor link 108 on both sides of the wheelchair 100. In one embodiment, the actuators (154 and 156) are configured to raise and lower the seat cushion 128 by raising the least one scissor link 108, thereby raising and lowering the seat cushion 128 to a desired adjustable height for the user. In one embodiment, the wheelchair 100 further comprises a pair of front wheels (148 and 150) and rear wheels (141 and 142). The front wheels rotate 360 degrees (148 and 150) and rear wheels (141 and 142) are both affixed to the pair of lower support bars (102 and 104), configured to rotate in a direction for providing maximum mobility for the wheelchair 100. In one embodiment, the wheelchair 100 further comprises a foot rest assembly. The foot rest assembly includes a pair of leg support bars (132 and 134) carrying foot rests (136 and 138), pivotally affixed to the seat frame support bars (114 and 116) via gas shock absorbers (140 and 143).

In another embodiment, the foot rest assembly is incorporated with the footrest (136 and 138) is affixed to the leg frame support bars (132 and 134) and the at least one scissor link on both sides of the wheelchair 100 in a rotated fashion form a static position to the translating vertical positions, while maintaining the proper distance when the actuators are initiated. In one embodiment, the gas shock absorbers (140 and 143) also simultaneously extends while rotating, also maintaining a positive ft/lb load that supports the user's body and leg weight. This was designed as an important safety measure to prevent the user's feet from dangling and unsupported during lifting the seat cushion 128.

In one embodiment, the footrest (136 and 138) are further configured to adjust at desired angles based on the requirement of the user. In one embodiment, the foot rests (136 and 138) of the foot rest assembly further comprises extended platforms 139. In one embodiment, the foot rest assembly further comprises an adjustment fitting assembly, a plate, and a lever. In one embodiment, the adjustment fitting assembly is designed with a gear and safety key-way that matching the plate and lever with angle positions in increments of, but not limited to, 32.5 degrees. In one embodiment, the adjustment lever could be a spring-loaded adjustment lever for users with limited grip, to operate with normal pressure and rotate the footrest until next position. The combined functions allow the flexure and blood circulation of the foot and ankle, establishing a range of motion by adjusting the footrest (136 and 138).

Figure 2:
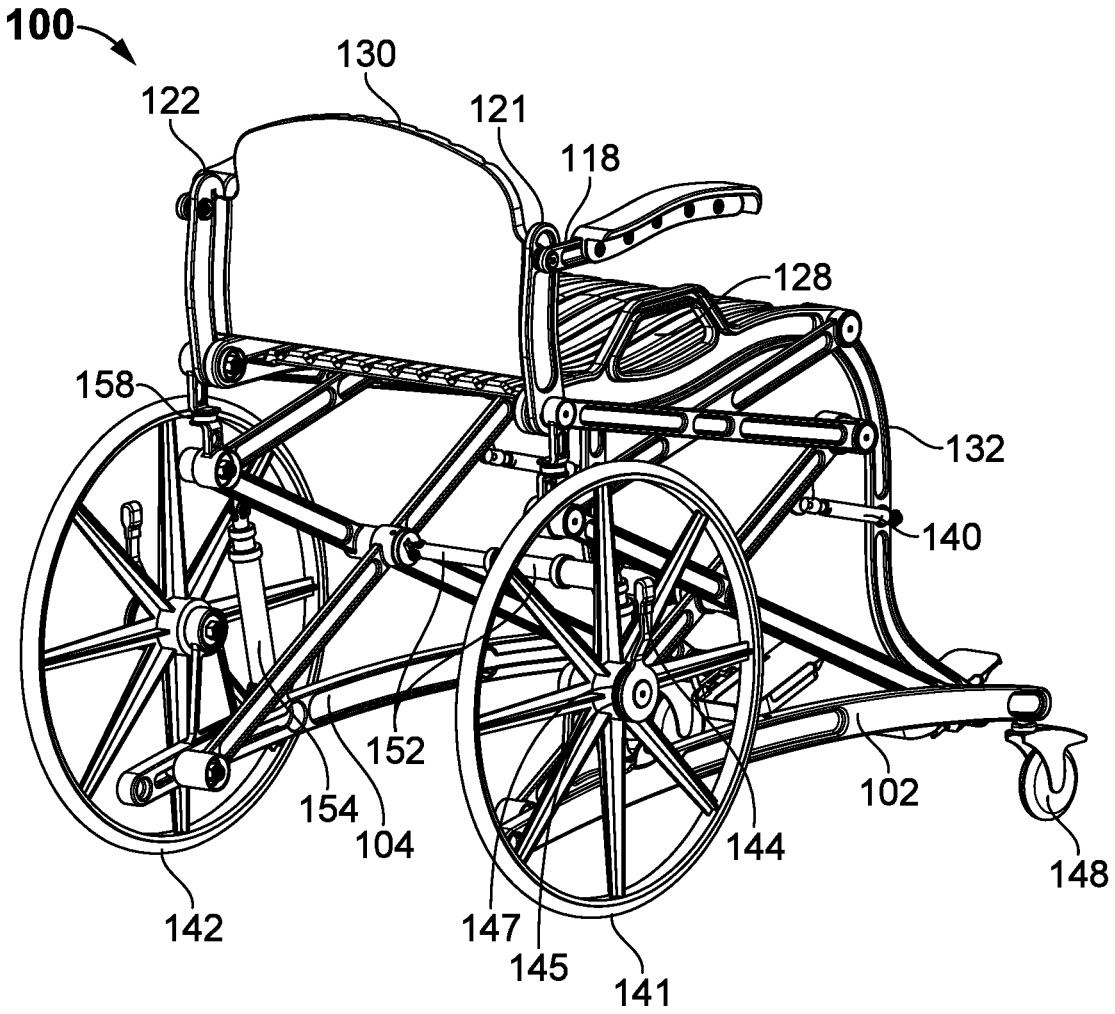
FIG. 2 shows a rear perspective view of the wheelchair incorporated with the lift apparatus in one embodiment of the present invention.

Referring to FIG. 2, the wheelchair 100 further comprises at least one actuator 152 diametrically disposed between the support assembly. In one embodiment, the plurality of scissor links (106, 108, 110, and 112) (shown in FIG. 1) on both sides of the wheelchair 100 could be connected via the actuator 152. In one embodiment, the actuator 152 is configured to stabilize the wheelchair 100 for lateral movements. In one embodiment, the backrest cushion 130 is configured to distribute body weight load and surface area to reduce pressure points on the user's skin and improve blood flow. The backrest cushion 130 is designed with ridges which function to increase airflow to help cool user's skin, prevent increased body temperature and pressure causing ulcers on the user's skin.

In one embodiment, the wheelchair 100 further comprises shock absorbers 158 positioned between the plurality of scissor links on both side of the wheelchair 100. In one embodiment, the shock absorbers 158 are configured to provide stability and reduce friction between the plurality of scissor links (106, 108, 110, and 112). In one embodiment, the shock absorbers 158 are rubber shock absorbers. The shock absorbers 158 could provide soft stops between the scissor links (106, 108, 110, and 112) and prevents wear due to constant friction. In one embodiment, the shock absorbers 158 could be positioned between the actuators (152, 154, and 156) they function to provide dampening vibration, shock absorptions, and provide a smooth ride on rough surfaces whether the wheelchair 100 is being operated by the user or assisted by a caregiver.

Figure 3:
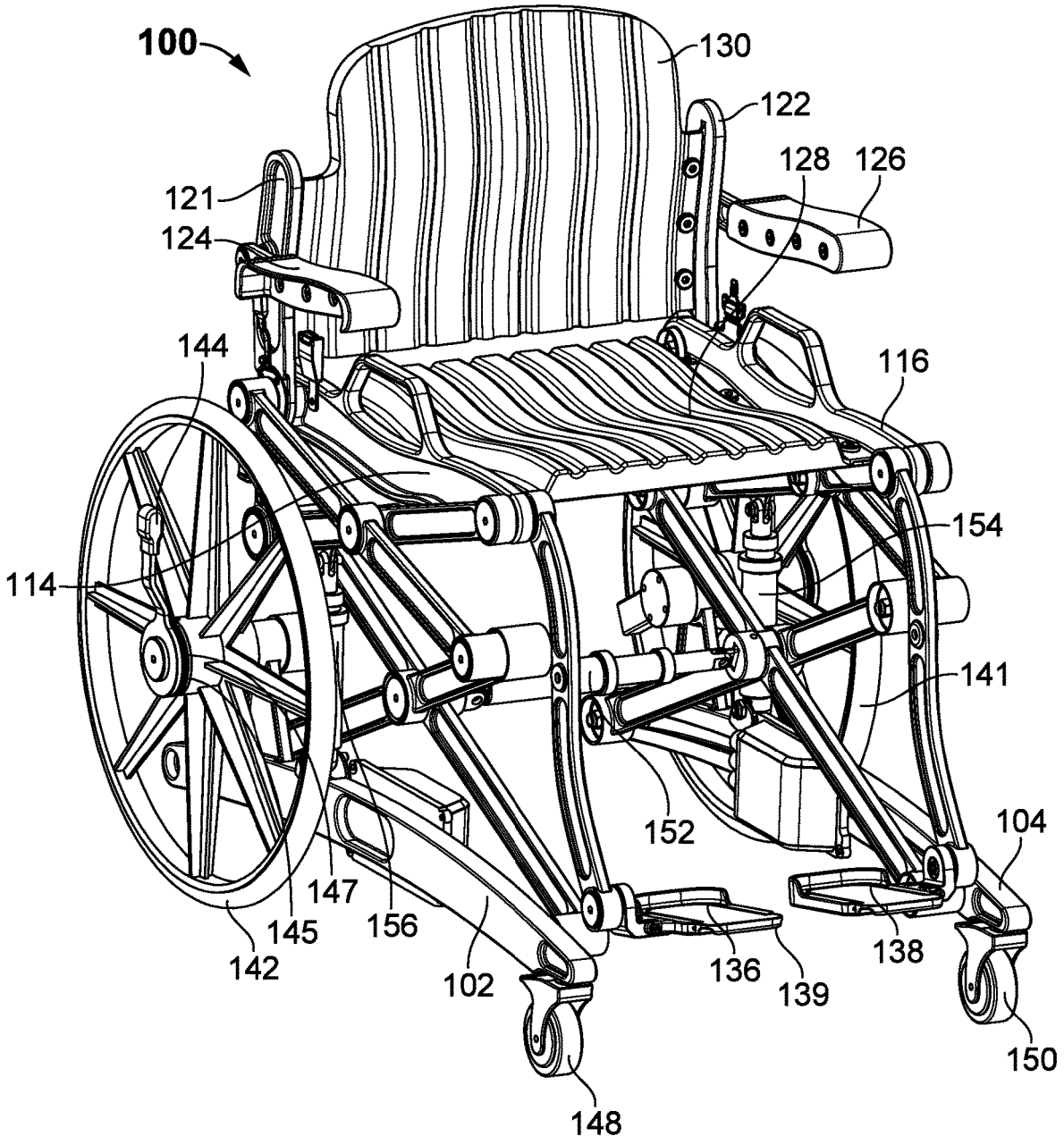
FIG. 3 shows a front perspective view of the wheelchair incorporated with the lift apparatus in one embodiment of the present invention

Referring to FIG. 3, the seat frame support bars (114 and 116) and backrest support bars (121 and 122) are securely holding the seat cushion 128 and backrest cushion 130. In one embodiment, the seat frame support bars (114 and 116) and backrest support bars (121 and 122) are designed with adjustable reclining positions for increasing comfort for the user. The seat cushion 128 and backrest cushion 130 could provide pressure relief and skin protection for the user and reduce pressure sores by shifting body positions.

In one embodiment, the lower frame support bars (102 and 104) includes, but not limited to, a curved shaped design. The lower frame support bars (102 and 104) are further configured to withstand large bending loads in a static and dynamic operating condition during lifting the seat cushion 130 using lift apparatus. In one embodiment, the front wheels (148 and 150) are affixed to the lower frame support bars (102 and 104) at a predefined distance from the rear wheels (141 and 142) to place the user's center of gravity as to prevent the wheelchair 100 from tipping over or backwards when the support bars (121 and 122) are adjusted to desired angle positions. In one embodiment, the seat frame support is designed with integral handles on (114 and 116) are further configured to provide support for manually lifting the wheelchair 100 and placing in the vehicle for transportation.

In one embodiment, the backrest frame handle bars on (121 and 122) are provided with a pistol grip spring-loaded plunger. In one embodiment, the backrest frame handle bars on (121 and 122) are configured to rotate counter clockwise when the pistol grip spring loaded plunger is engaged. The caregiver could easily shift control from the primary user from the wheelchair by manually rotating the backrest frame handle bars on (121 and 122). In one embodiment, the backrest frame handle bars (121 and 122) could automatically rotate and lock by pressing a button via the spring-loaded plunger when the wheelchair 100 folded and stored for transport using vehicles. In one embodiment, the backrest frame handle bars on (121 and 122) could be locked by a locking plunger pin. The locking plunger pin is designed to support large down force loads.

In one embodiment, the foot rests (136 and 138) of the foot rest assembly further comprises extended platforms 139. The user simply rests feet on the extended platforms 139 designed to be part of the wheelchair 100, in order to allow movement or mobility either forward or backward without contact with the floor or ground surface. In one embodiment, the extended platforms 139 are configured to extend and retract about, but not limited to, 5 inches from the base position to accommodate the user's feet size and for users who lack full grip and hand strength. In one embodiment, the extended platforms 139 includes a sliding fit designed with 2 rows of spring-loaded plunger bearings embedded between the two parts and spaced to adjust the footrest. The extended platforms 139 of each foot rests (136 and 138) are designed with a raised lip on the underside for grip purpose. The extended platforms 139 could be depressed back to its stowed position with normal pressure. The extended platforms 139 also prevents the user from cutting off circulation to the feet when barefoot, due to the lack of insufficient length of the footrest on standard wheelchairs.

Figure 4:
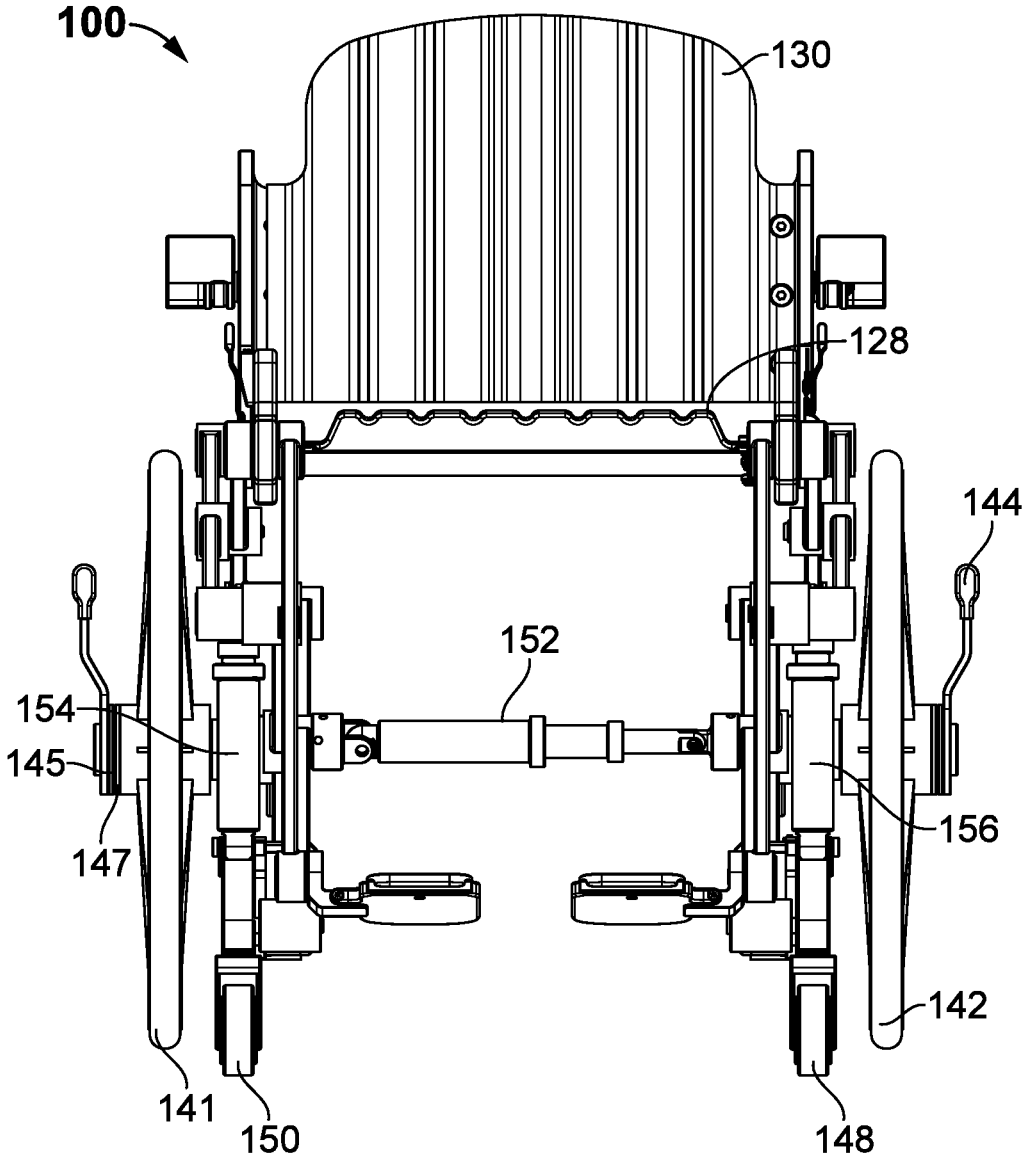
FIG. 4 shows a front view of the wheelchair incorporated with the lift apparatus in one embodiment of the present invention.

Referring to FIG. 4, the actuators (152, 154, and 156) are configured to control and stabilize the movements of the wheelchair 100. In one embodiment, the actuators (152, 154, and 156) further configured to automatically fold and unfold the wheelchair 100 while transporting using a vehicle. In one embodiment, the actuators (152, 154, and 156) could be, but not limited to, micro electrical actuators. In one embodiment, the wheelchair 100 further comprises an automatic powered mechanical assist, configured to automatically fold and unfold the wheelchair 100 without an effort so it saves time and energy for the user. The wheelchair 100 allows the user for easy folding or clasping the wheelchair 100 for transporting by vehicle, as well as expanding the wheelchair 100 to its designed seat width for the user. This feature also functions to expand the seat cushion 128 and backrest cushion 130 to a locked set width to prevent sagging, therefore the user could change body posture positions for maximum comfort.

Figure 5:
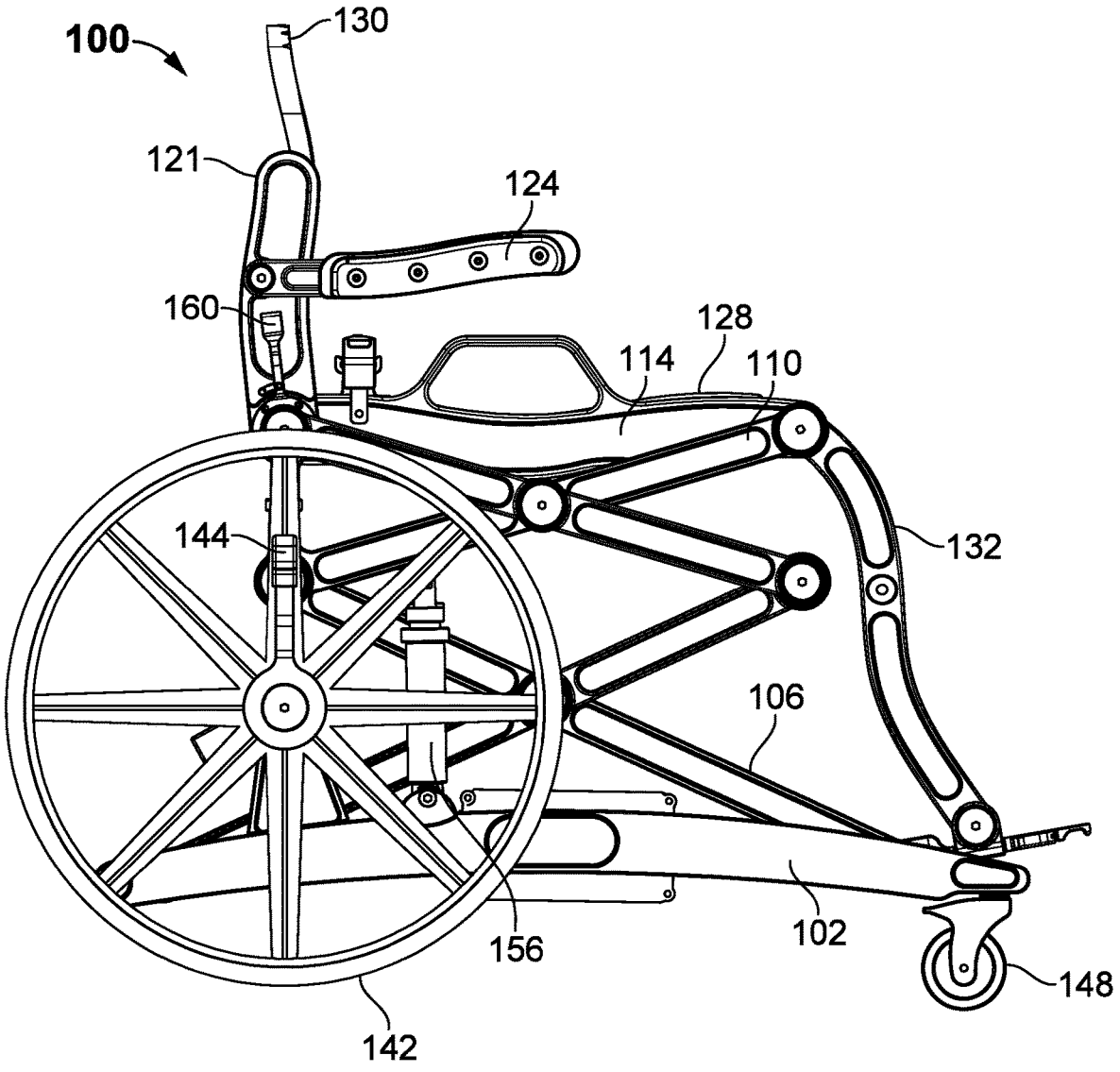
FIG. 5 shows a side view of the wheelchair incorporated with the lift apparatus in one embodiment of the present invention.

Referring to FIG. 5, the seat frame support bars (114 and 116) (shown in FIG. 3) and backrest support bars (121 and 122) (shown in FIG. 3) are provided with a gear and a sprocket. In one embodiment, the backrest support bars (121 and 122) are manually adjusted by the user using an adjustment lever 160. In one embodiment, the adjustment lever 160 is provided with a key-way slot for providing safety for the user. In one embodiment, the adjustment lever 160 could be a spring-loaded lever. In a preferable embodiment, the backrest support bars (121 and 122) could be reclined about, but not limited to, 235 degrees within at least 4 positions. The reclined positions of the backrest support bars (121 and 122) could reduce fatigue and tiredness for the back muscles. In one embodiment, the wheelchair 100 is further configured to automatically fold for easy transportation using vehicles. In one embodiment, the backrest support bars (121 and 122) are manually tilting independently operable relative to the seat frame support bars (114 and 116).

In one embodiment, the wheelchair 100 further comprises a rear wheel braking system, configured to lock the rear wheels (141 and 142) (shown in FIG. 4) before initiating the lift apparatus for lifting the seat cushion 128 to a desired height. The rear wheel braking system is further configured to easily brake the rear wheels (141 and 142) and control the speed of the wheelchair 100. In one embodiment, the rear wheel braking system includes a brake lever 144, a brake plate 145 (shown in FIG. 4), and a brake pad 147 (shown in FIG. 4), positioned at a center portion of the rear wheels (141 and 142). The brake lever 144 is disposed at the center portion of the rear wheels (141 and 142) to enable the user for easily braking the rear wheels (141 and 142) while in motion to control the speed of the wheelchair 100. The rear wheel braking system increases safety for the user and prevents injuries with a greater ability to control the speed and stirring of the wheelchair 100 when operating on downhill surfaces or downward slopped sidewalks or other surfaces in order slow or reduce speed. The functions of the three components allow friction between the brake plate 145 and brake pad 147 unique design function to brake when the wheelchair 100 is in motion and could safely lock when the brake lever 144 is thrust forward to the end of a short angle rotation. This locking action is the most important feature/function before energizing the actuators (154 and 156) for lifting the seat cushion 128 to a desired height. Once the seat cushion 128 is returned to its stowed or initial position to unlock the rear wheels (141 and 142), normal force should be used to pull the brake lever 144 in the opposite direction to the original position to completely release the brake. This rear wheel braking system eliminate injuries to user's hands while braking and reduces the cost of wheel replacement due to detraction and damage of current wheelchair 100 brake system.

Figure 6:
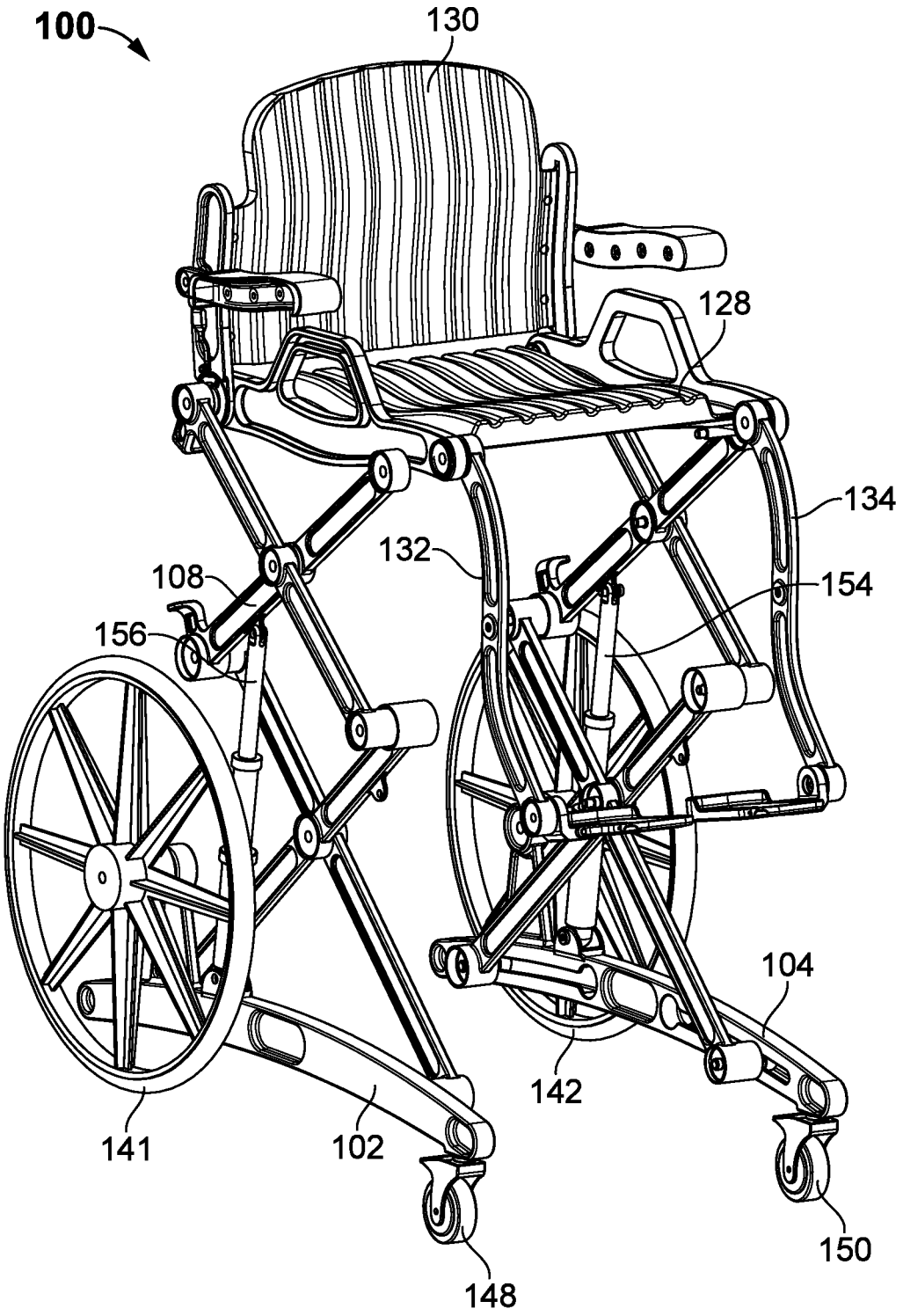
FIG. 6 shows a front perspective view of a seat cushion of the wheelchair raised via the lift apparatus in one embodiment of the present invention.
Figure 7:
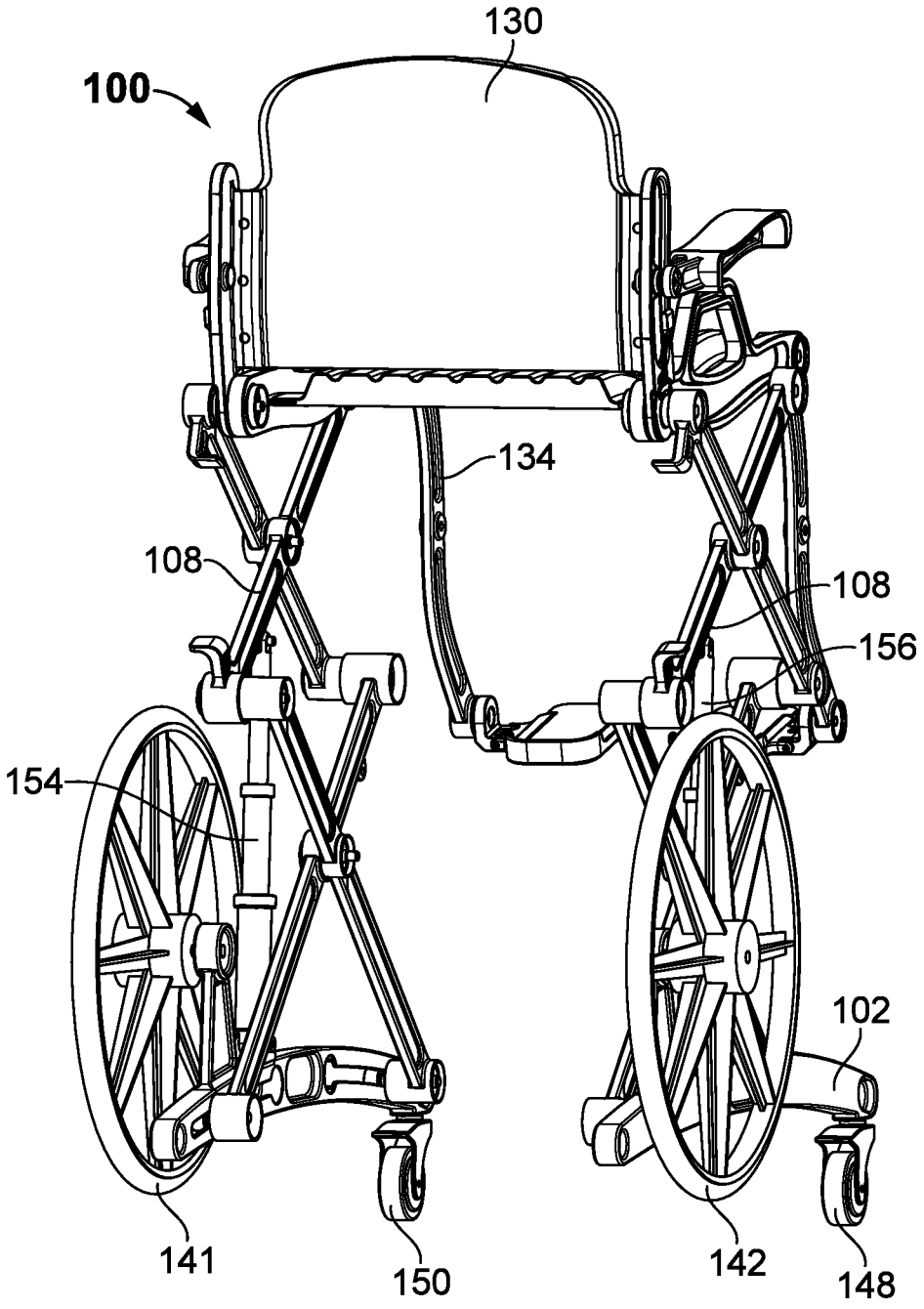
FIG. 7 shows a rear perspective view of the seat cushion of the wheelchair raised via the lift apparatus in one embodiment of the present invention.
Figure 8:
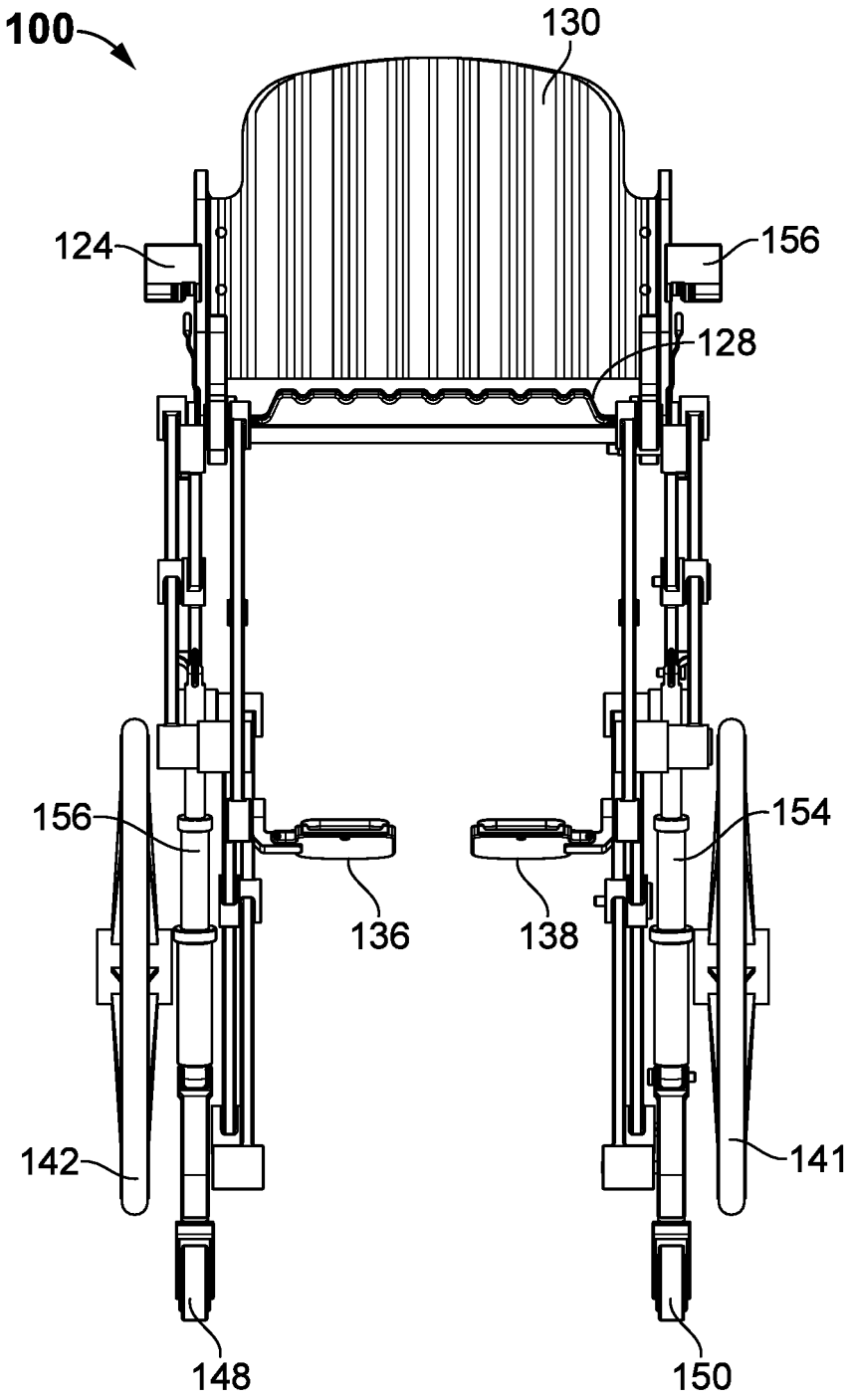
FIG. 8 shows a front view of the seat cushion of the wheelchair raised via the lift apparatus in one embodiment of the present invention.

Referring to FIGS. 6-8, the wheelchair 100 enables the user to lift the seat cushion 128 using the lift apparatus. The actuators (154 and 156) on both sides of the lower frame support bars (102 and 104) could raise and lower the seat cushion 128 by raising at least one scissor link 108 when energized forces are applied, thereby raising and lowering the seat cushion 128 to a desired adjustable height. In one embodiment, the actuators (154 and 156) could raise the seat cushion 128 at a maximum height of, but not limited to, 25 inches with a lifting capacity of approximately, but not limited to, 600 lbs for each actuator (154 and 156) on both sides. In one embodiment, the actuators (154 and 156) could lower the seat cushion 128 at a minimum height of, but not limited to, 3 to 5 inches below the initial static position.

In one embodiment, the lower frame support bars (102 and 104) further configured to provide space for additional components, for example, rotary actuators. In one embodiment, the rotary actuators could be positioned between the lower frame support bars (102 and 104) and the rear wheel axels. In one embodiment, the rotary actuators are configured to allow and expand the wheelchair 100 functionality to be transformed into a rear wheel powered wheelchair with independent rotary drive mechanisms powered by batteries. The rear wheels (141 and 142) with independent rotary drive mechanism could provide a zero-turn radius and ease of steering and control for the user. Adding the rotary actuators to complement the micro linear actuators will give the user combined power to take advantage of multi-directions forward and backwards while lifting the seat cushion 128 with a simple touch controls at their fingertips.

Figure 9:
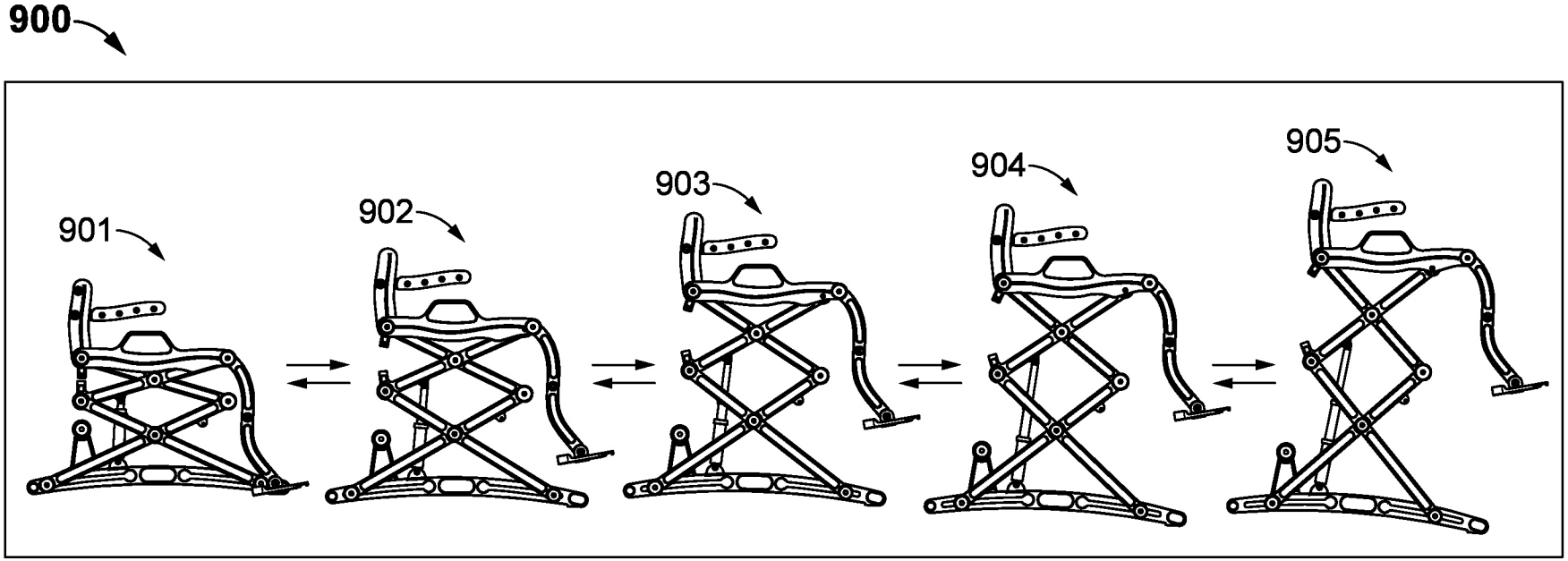
FIG. 9 shows a method of raising and lowering the seat cushion of the wheelchair using the lift apparatus in an embodiment of the present invention.

Referring to FIG. 9, a method 900 for raising the seat cushion 128 at a desired height using the lift apparatus of the wheelchair 100. In one embodiment, the seat cushion 128 (shown in FIG. 2) could be raised at a desired height by the user for reaching the heights of stages or platforms at different locations, for example, home, hospitals, super markets, grocery stores, and entering and exiting from the vehicle with minimum effort. The steps 901 to 905 involved in the method 900 for raising the seat cushion 128 at a desired height by the user using the lift apparatus. The actuators (154 and 156) (shown in FIG. 4) could rise at least one scissor link 108 of the support assembly on both sides for raising the seat cushion 128. In one embodiment, the seat cushion 128 could be raised at a maximum height of, but not limited to, 25 inches with a lifting capacity of approximately, but not limited to, 600 lbs. The user could lock the rear wheels (141 and 142) using the rear wheel braking system before initiating the lift apparatus. The steps 905 to 901 involved in the method 900 for lowering the seat cushion 128 at a desired height by the user. The actuators (154 and 156) could lower at least one scissor link 108 of the support assembly on both sides for lowering the seat cushion 128. In one embodiment, the seat cushion could be lowered at a minimum height of, but not limited to, 3 to 5 inches below the initial position.

The advantages of the present invention include: the wheelchair 100 enables the user to lift the seat cushion 128 at desired heights at different locations, for example, home, hospitals, grocery stores, super markets, closets, and retail stores and other environments, for reaching the stages and platforms in a safe and reliable manner without requiring any assistant from the caregiver. The wheelchair 100 is designed to aid and improve mobility for individuals with limited disabilities and handicaps. The seat cushion 128 and backrest cushion 130 are configured to adjust at desired angle positions for providing flexibility and comfort for the user and reduce possible pressure points on the user's skin tissue. The wheelchair 100 is lightweight and collapsible for easy and compact vehicle transportation. The user could easily shift from the wheelchair 100 to any platform, for example, bed, medical diagnostic equipment. The user could easily enter and exit from a vehicle such as, but not limited to, car and truck quickly with minimum effort without assistance from a caregiver. In one embodiment, the components of the wheelchair 100 such as, lower frame support bars (102 and 104), seat frame support bars (114 and 116), backrest support bars (121 and 122), seat cushion 128, and backrest cushion 130 are made of a material, but not limited to, a metal. In a preferred embodiment, the components of the wheelchair 100 are made of high strength aircraft grade aluminum. The components of the wheelchair 100 are environmentally friendly, maintenance-free, cost-effective, and hospital bacteria contaminate free.

Preferred embodiments of this invention are described herein, including the best mode known to the inventors for carrying out the invention. It should be understood that the illustrated embodiments are exemplary only and should not be taken as limiting the scope of the invention.

The foregoing description comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings in the foregoing descriptions. Although specific terms may be employed herein, they are used only in generic and descriptive sense and not for purposes of limitation. Accordingly, the present invention is not limited to the specific embodiments illustrated herein.

What is claimed is:

1. A wheelchair incorporated with a lift apparatus, comprises:

a pair of seat frame support bars configured to secure at least one seat cushion;

a pair of backrest support bars configured to secure a backrest cushion;

a pair of armrest frame support bars movably affixed to the pair of backrest support bars;

a pair of lower support bars positioned parallel and opposite each other on both sides of the wheelchair;

a support assembly includes a plurality of scissor links on both sides of the wheelchair, wherein the plurality of scissor links is pivotally connected to each other, and an end of the plurality of scissor links is pivotally affixed to the lower support bar and the seat frame support bar via fasteners, a lift apparatus includes one or more actuators positioned between the lower support bars and at least one scissor link on both sides, wherein the one or more actuators are configured to raise and lower the seat cushion by raising the least one scissor link, thereby raising and lowering the seat cushion to a desired adjustable height for a user;

a foot rest assembly includes a pair of leg support bars carrying a foot rest, pivotally affixed to the pair of seat frame support bars via gas shock absorbers; and a pair of front wheels that rotate 360 degrees and rear wheels that both are affixed to the pair of lower support bars, configured to rotate in a direction for providing maximum mobility for the wheelchair.

2. The wheelchair of claim 1, is made of a material that includes a metal and an aluminum.

3. The wheelchair of claim 1, wherein the backrest cushion is configured to adjust at desired angle positions for providing flexibility and comfort for the user.

4. The wheelchair of claim 1, further comprises a pair of armrest cushions affixed to the pair of armrest frame support bars.

5. The wheelchair of claim 1, further comprises a rear wheel braking system, configured to lock the rear wheels before initiating the lift apparatus for lifting the seat cushion to a desired height.

6. The wheelchair of claim 5, wherein the rear wheel braking system is further configured to easily brake the rear wheels and control the speed of the wheelchair.

7. The wheelchair of claim 5, wherein the rear wheel braking system includes a brake lever, a brake plate, and a brake pad, positioned at a center portion of the rear wheels.

8. The wheelchair of claim 7, wherein the brake lever is disposed at the center portion of the rear wheels to enable the user for easily braking the rear wheels while in motion to control the speed of the wheelchair.

9. The wheelchair of claim 1, wherein the actuators are micro-electrical actuators.

10. The wheelchair of claim 1, wherein the at least one actuator is diametrically disposed between the support assembly.

11. The wheelchair of claim 1, wherein the one or more actuators are configured to stabilize the wheelchair for lateral movements.

12. The wheelchair of claim 1, further comprises an automatic powered mechanical assist, configured to automatically fold and unfold the wheelchair.

13. The wheelchair of claim 1, wherein the foot rests are configured to adjust at desired angle positions for providing flexibility and comfort for the user.

14. The wheelchair of claim 1, wherein the foot rests further comprise an extension portion, configured to extend and retract to a desired length for accommodating different foot sizes of the users.

15. The wheelchair of claim 1, wherein the gas shock absorbers are disposed between the leg support bars and the at least one scissor link on both sides.

16. The wheelchair of claim 1, wherein the gas shock absorbers are configured to provide flexible movement for the foot rest assembly.

17. The wheelchair of claim 1, further comprises shock absorbers positioned between the plurality of scissor links, configured to provide stability and reduce friction between the plurality of scissor links.

18. The wheelchair of claim 17, wherein the shock absorbers are rubber shock absorbers.

19. The wheelchair of claim 1, wherein the wheelchair includes a rotary actuator to lift the wheelchair.

* * * * *